US005522582A

United States Patent [19]

Dilks

[11] Patent Number: 5,522,582

[45] Date of Patent: Jun. 4, 1996

[54] REMOTE CONTROLLED WINCH

[75] Inventor: Jerry L. Dilks, West Linn, Oreg.

[73] Assignee: Warn Industries, Inc., Milwaukie, Oreg.

[21] Appl. No.: 330,389

[22] Filed: Oct. 27, 1994

[51] Int. Cl.[6] ..... B66D 1/12; B66D 1/22

[52] U.S. Cl. ..... 254/323; 242/587.2; 254/344; 254/362; 254/371; 254/DIG. 14

[58] Field of Search ..... 254/219, 323, 254/324, 325, 326, 327, 328, 344, 362, 371, DIG. 14; 242/587, 587.2, 613.1

[56] References Cited

U.S. PATENT DOCUMENTS

| | | | |
|---|---|---|---|
| 823,401 | 6/1906 | Ferris | 254/DIG. 14 |
| 1,413,292 | 4/1922 | Rauscher | 254/346 X |
| 1,550,114 | 8/1925 | Simpson | 254/344 X |
| 2,700,481 | 1/1955 | Donatelli | 254/362 X |
| 4,158,797 | 6/1979 | Alcott | 254/362 X |
| 4,331,323 | 5/1982 | Sekimori et al. | 254/323 |
| 4,736,929 | 4/1988 | McMorris | 254/323 X |
| 4,789,135 | 12/1988 | Watanabe | 254/362 |
| 4,844,421 | 7/1989 | Kojima | 254/362 X |
| 4,858,890 | 8/1989 | Fowler et al. | 254/326 X |
| 5,072,962 | 12/1991 | Webb | 254/323 X |

*Primary Examiner*—Joseph J. Hail, III

*Attorney, Agent, or Firm*—Klarquist, Sparkman, Campbell, Leigh & Whinston

[57] ABSTRACT

A remote controlled winch operable by a hand held remote control. The winch has a single piece drum that is reversibly driven by a drive motor through a planetary gear arrangement for winding cable onto the drum and unwinding cable off the drum. A remote control capable of handling the high amperage draw of the drive motor is provided to control power to and the rotative direction of the drive motor. The remote control has two switch arms that are connected to the motor leads with each of the switch arms normally biased to a ground connection. A manually operated mechanism is provided to selectively and independently switch (move) each of the switch arms from a ground connection to a connection with a power source to supply power to the motor and control the rotative direction of motor.

4 Claims, 4 Drawing Sheets

REMOTE CONTROLLED WINCH

FIELD OF THE INVENTION

This invention relates to a winch having a rotatable drum for winding and unwinding a winch cable and more particularly to the manner of controlling the winding and unwinding operation by remote control.

BACKGROUND OF THE INVENTION

Winches are typically mounted to a vehicle and powered by the vehicle's battery, i.e., with DC current. A winch may be used, for example, to pull the vehicle out of a stuck condition. The winch cable is unwound from the drum, anchored, e.g., to a tree, and then wound back onto the winch to pull the vehicle toward the tree. Winding and unwinding of the winch is accomplished by reversing the rotation of the drum of the winch on which the cable is wound. This is achieved by switching the polarity of the DC current as applied to the winch motor.

A switch mounted to the winch motor will accomplish the three rotative conditions as between off, rotation, and counter rotation. However, it is often desirable to operate the winch motor as between the three conditions from a position remote from the winch. For example, the operator may not want to stand in front of the vehicle operating the winch as the winch is causing the vehicle to move forward.

Large winches used for heavy duty application are commonly equipped with the desired remote control. A control box mounted to the motor includes a solenoid which is electrically actuated to switch the winch motor between off, rotate, and counter rotate. The solenoid is actuated by a low voltage current applied through conductive wires leading to a handheld switch, i.e., a remote control.

Whereas the remote control described is very acceptable for large winches, there is a need for remote control on smaller winches as well. The category of winches here considered as a smaller winch is one which is designed, e.g., to apply 1,000 pounds of pulling force as compared to 5,000 pounds of pulling force for what is considered the large winches. The smaller winches are considerably less expensive and are thus available for many applications that cannot justify the expense of the larger winches. For example, an all terrain vehicle (ATV) used for recreation purposes will weigh in at several hundred pounds as compared to, e.g., a truck at well over three thousand pounds. The smaller winch mounted to the front end of the ATV will pull the ATV out of a stuck condition. The owner of the ATV may want to have a winch but not at the price of the large winches. This is but one example of many that make up a demand for the smaller winches as long as the cost is contained. It is therefore an objective of the small winch manufacturer to keep the manufacturing costs to a minimum. The solenoid pack (control box) itself is a major item cost wise and is not typically supplied on the smaller winches even though desirable as an accessory to the small winch owner.

BRIEF DESCRIPTION OF THE PRESENT INVENTION

It is accordingly an object of the present invention to provide a low cost remote control for a small winch. In the preferred embodiment the wire conductors that normally run from the vehicle battery to the solenoid pack at the winch motor (power and ground) instead run to a handpiece that serves as the remote control. A second set of wires runs from the handpiece back to the winch motor. The power and ground conductors for the battery terminate at the hand piece in two spaced apart conductive plates, the ground plate overlying the power plate. The two winch motor conductors terminate in spring members that are located between the plates and are spring biased against the ground plate. First and second buttons on the handpiece are positioned to selectively deflect the two spring members respectively toward the underlying power plate. Thus, with the buttons not depressed, both winch motor conductors are in contact with the ground plate and not the power plate and the motor is without power and in the off condition. Manual depressing of one of the buttons causes one of the winch motor conductors to disconnect from ground and connect to power and the winch motor is driven in one rotative direction causing rotation of the winch drum. Release of that button and engagement of the other button reverses the motor and the rotation of the winch drum.

The remote control is simple in design and construction and adds little to the cost of the small winch. These and other advantages will be more clearly appreciated upon reference to the following detailed description having reference to the accompanying drawings.

DESCRIPTION OF THE PREFERRED EMBODIMENT

Figure 1:
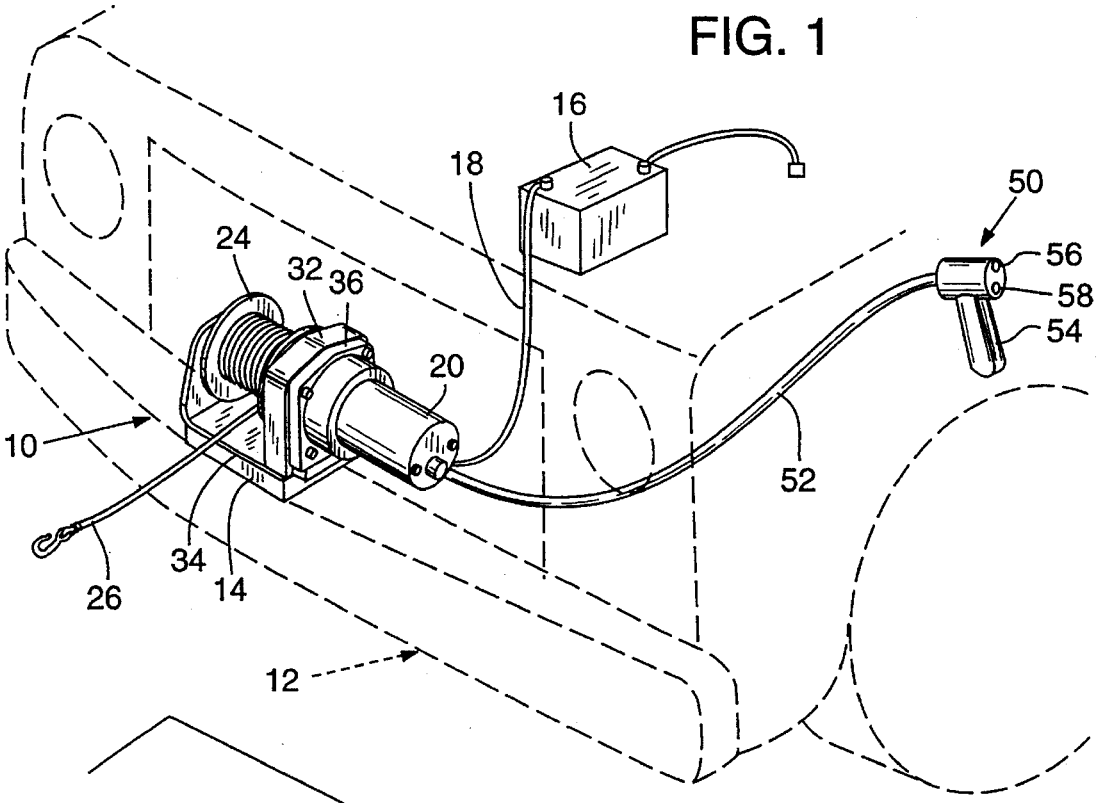
FIG. 1 is a view of a remote controlled winch of the present invention mounted on a vehicle.

Refer to FIG. 1 of the drawings which illustrates a remote controlled winch 10 of the present invention mounted on a vehicle 12, such as an all terrain vehicle (ATV). The winch 10 includes an electric drive motor 20 and the motor 20 is powered by the vehicle battery 16. A cable 18 is provided to supply power from the battery 16 to the winch 10. The winch 10 is mounted on a suitable mounting bracket 14 provided on the vehicle 12. The winch 10 is shown mounted on the front of the vehicle 12, but it will be appreciated that the winch may also be mounted at other positions such as on the rear of the vehicle.

Figure 2:
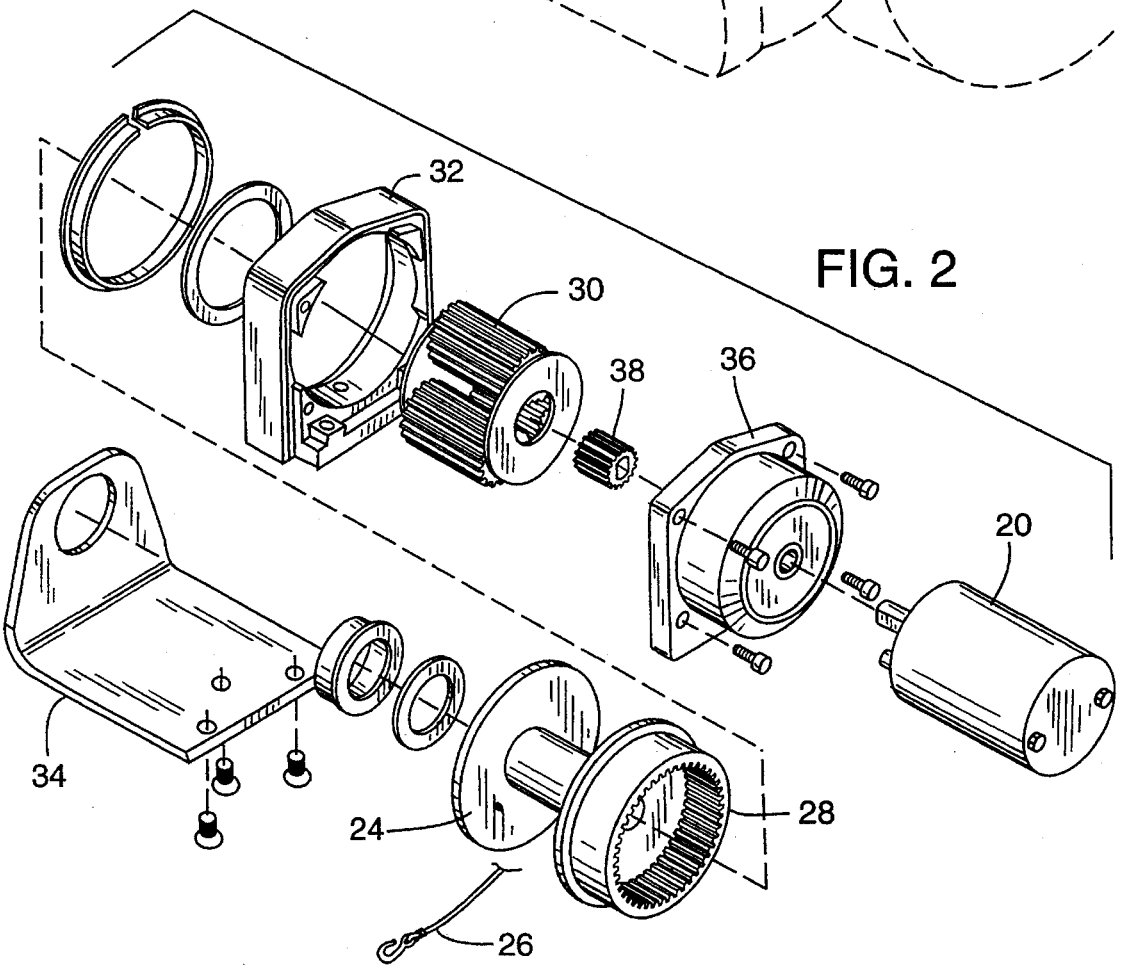
FIG. 2 is an exploded view of the remote controlled winch of FIG. 1.
Figure 7:
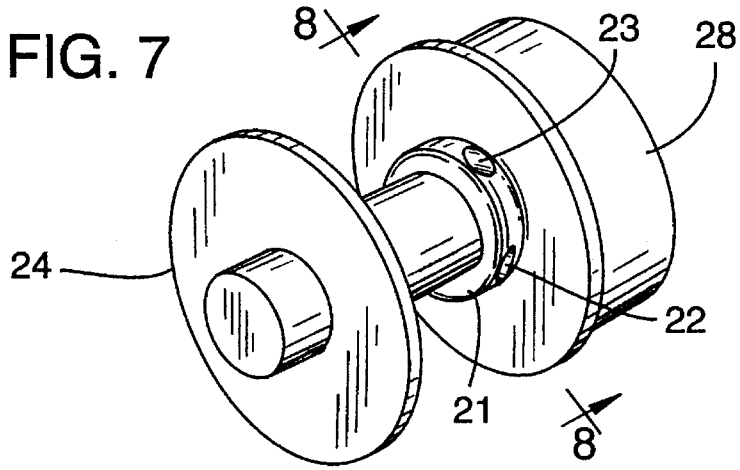
FIG. 7 is another view of the cable drum of the winch of the present invention; and, FIG. 8 is a view of the cable drum as viewed on view lines 8—8 of FIG. 7.
Figure 8:
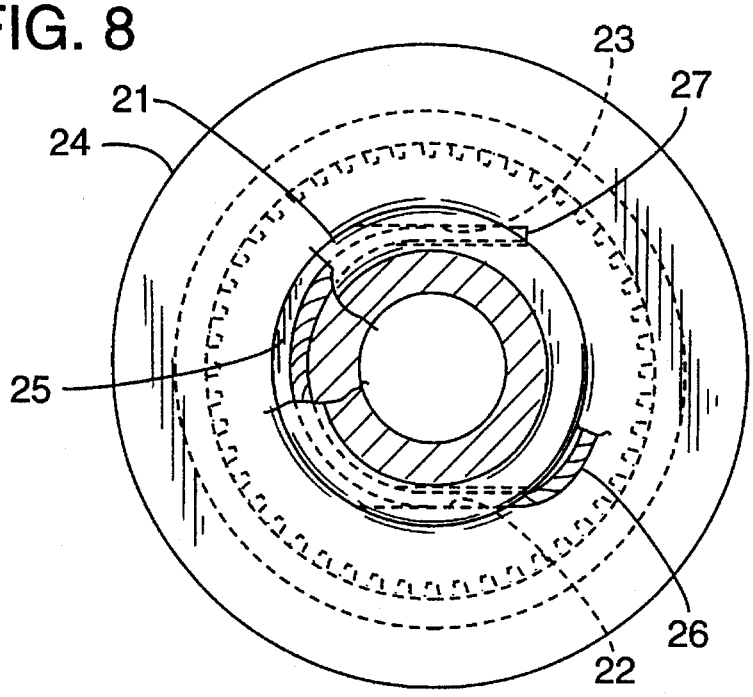

The winch 10 is further illustrated in the exploded view of FIG. 2. The winch 10 has a drum 24 for receiving a length of wire rope (cable) 26. The drum 24 is preferably of a one piece casting with a ring gear 28 formed in one end and has a unique fastening arrangement for securing an end of the wire rope to the drum. An end of the wire rope 26 is secured to the drum 24 without the use of auxiliary fasteners as illustrated in FIG. 8 in conjunction with FIG. 7. A hub 21 of the drum 24 has through bores 22, 23 and a groove 25. An end 27 of the wire rope 26 is inserted through the bore 22 and is extended to fit into the bore 23 with the end 27 terminating at the end of the bore 23 as shown. The wire rope 26 is snubbed into the groove 25 between the bores 22 and 23. The wire rope 26 is thus secured to the drum 24. It is typically recommended that the wire rope 26 have at least five wraps around the drum for additional security.

Figure 6:
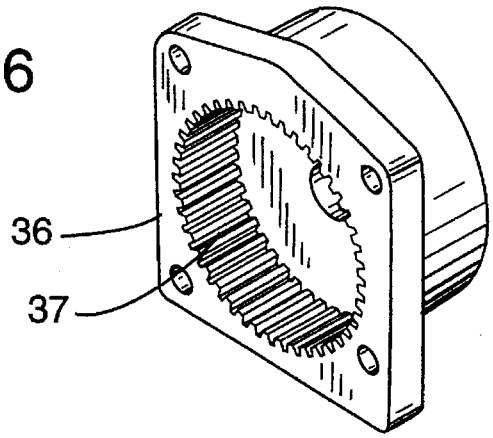
FIG. 6 is another view of the gear housing of the winch of the present invention.

The drum 24 has a ring gear 28 on one end that is arranged to receive in mesh a planetary gear set 30. The ring gear end 28 of the drum 24 is rotatably supported in a support housing 32. The other end of the drum 24 is rotatably supported in a support bracket 34. The bracket 34 also serves as a mounting plate to mount the winch to a vehicle. A gear housing 36 which has an internal gear form 37 (see FIG. 6) to mesh with the planetary gear set 30 is mounted to the support housing 32 and in combination with the ring gear end 28 of the drum 24 encloses and supports the planetary gear set 30. The support housing 32, the support bracket 34, and the gear housing 36 in combination form the base structure of the winch 10.

The planetary gear set 30 has three planet gears instead of the usual two. The planet gears of the gear set 30 are of extended length to provide a long face width on the gear form. This distributes the load across the face and also provides for quieter operation. Noise reduction is also accomplished by producing the gear housing 36 out of a material such as nylon.

The motor 20 is mounted to the gear housing 36 and has a drive pinion 38 coupled to its drive shaft (not shown) that drives the planetary gear set 30. The planetary gear set 30 as it is driven by the pinion 38 and being in mesh with the internal gear form 37 of the gear housing 36 and the ring gear 28 will cause the drum 24 to rotate. The number of gear teeth on the internal gear 37 of the gear housing 36 and the number of gear teeth on the ring gear 28 are unequal in number. In this embodiment the number of gear teeth on the internal gear 37 is fifty eight and the number of gear teeth on the ring gear 28 is fifty five.

The motor 20 is reversible so that the drum 24 may be driven in one direction to wind cable 26 onto the drum and driven in the opposite direction to unwind cable 26 off the drum 24.

The motor 20 of the winch 10 is operable by a remote control 50 (see FIG. 1). The remote control 50 in this embodiment has a suitable length of cable 52 and has a handle 54 (hand piece) that houses switch gear to control the operation of motor 20 with the handle 54 being suited for manipulation by one hand of an individual. The handle 54 includes a manually operated mechanism to operate the switch gear and in this embodiment, push buttons 56 and 58 are utilized to operate the switch gear within the handle 54 to provide power to the motor 20 and control the rotational direction of the motor depending on which push button 56, 58 is depressed (pushed). Depressing push button 56 will provide power to the motor 20 for rotation of the motor 20 in one rotative direction and depressing push button 58 will provide power to the motor 20 for rotation of the motor 20 in the opposite direction. The remote control 50 permits operation of the winch at a location remote from the winch itself. It will be appreciated that the remote control 50 may be permanently mounted at a location in the vehicle 12 such as in the operator's compartment and may be varied in its configuration. A permanent mount, for example, may not include the hand gripping portion of the handle 54.

Figure 3:
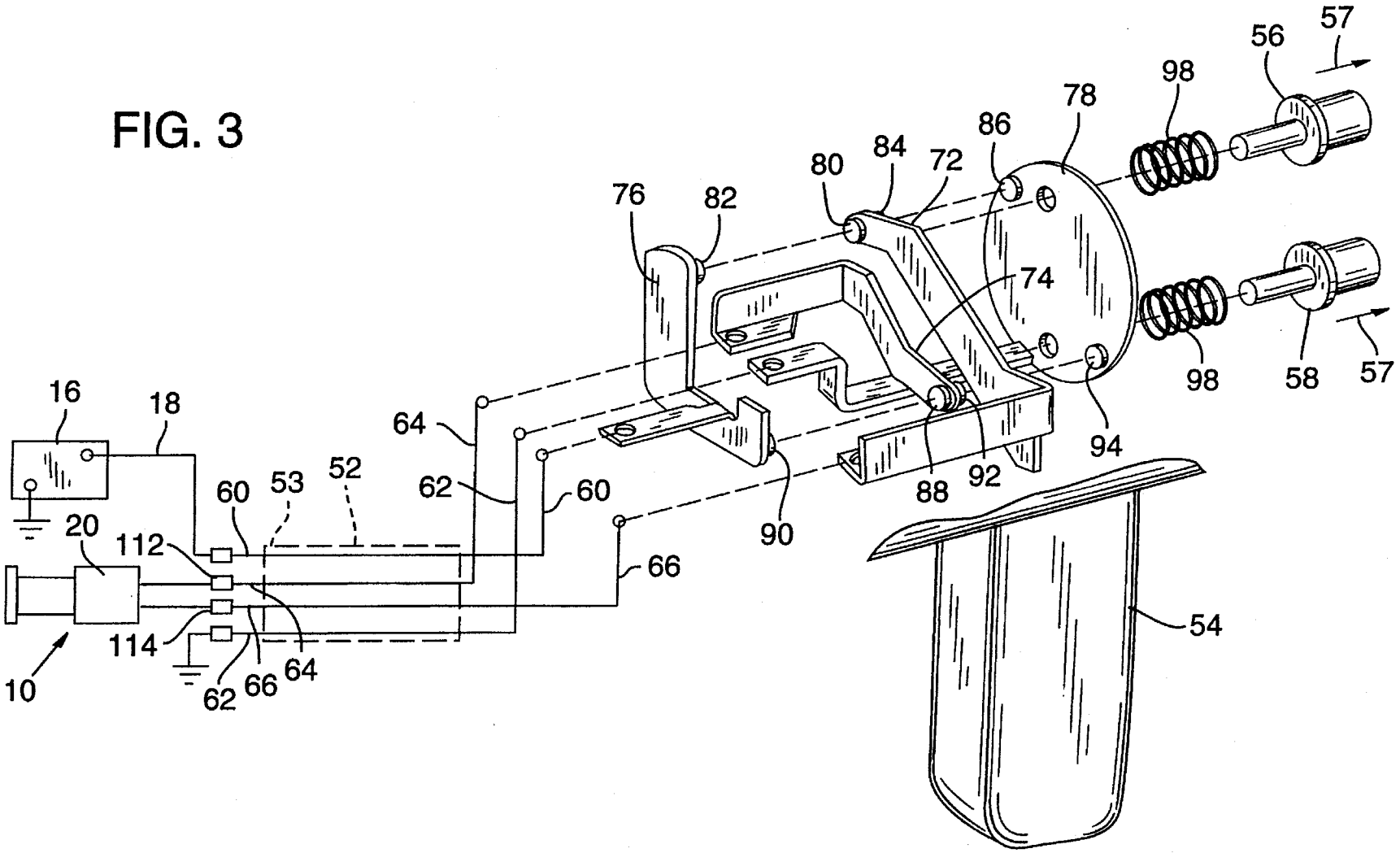
FIG. 3 is an exploded view of a remote control of the winch of FIG. 1.

The remote control 50 is further illustrated in the exploded view of FIG. 3. The cable 52 of the remote control 50 has four conductors; 60, 62, 64 and 66. The conductors 60, 62, 64 and 66 of the cable 52 must be adequate to conduct the high amperage current drawn by the motor 20. In this embodiment, each conductor 60, 62, 64 and 66 is of the stranded wire type and is equivalent to #8 wire. The conductors 60, 62, 64 and 66, in order to attain a high degree of flexibility are fabricated from smaller diameter wires than standard. In addition, the insulating sleeve surrounding each of the conductors 60, 62, 64 and 66 is thinner since it is not subject to high voltages. The conductors 60, 62, 64 and 66 are encased in a protective sleeve and a lubricant such as talcum is utilized between each of the conductors 60, 62, 64 and 66 to enhance the flexibility of the cable 52.

Figure 4A:
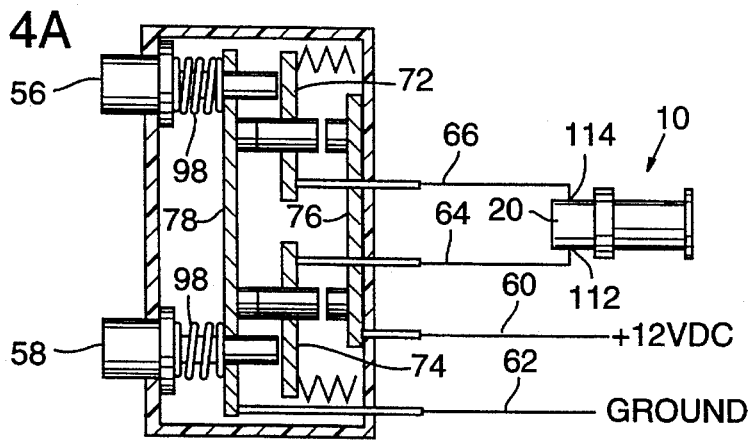
FIGS. 4A–4C are views illustrating the operation of the remote control of the winch of FIG. 1.

One end 53 of the cable 52 has conductor 60 connected to a power source such as the battery 16 (via cable 18) of the vehicle 12 and has conductor 62 connected to ground. Conductor 64 at end 53 is connected to a motor lead 112 and conductor 66 is connected to a motor lead 114 of the motor 20. Switch gear is included or mounted within the handle assembly 54 of the remote control 50. The switch gear in this embodiment is comprised essentially of two single pole, double throw switches that are normally biased to a connection with ground, which is best seen in the diagram of FIG. 4A. As seen in FIG. 3, conductor 60 is connected to a power plate 76 and the ground conductor 62 is connected to a ground plate 78. Motor lead 66 is connected to a switch arm (pole) 72 and motor lead 64 is connected to a switch arm (pole) 74. Switch arm 72 has a contact button 80 mounted strategic to a contact button 82 on the power plate 76. The switch arm 72 also has a contact button 84 mounted strategic to a contact button 86 on the ground plate 78. Similarly switch arm 74 has a contact button 88 mounted strategic to a contact button 90 of the power plate 76 and has a contact button 92 mounted strategic to a contact button 94 of the ground plate 78. The switch arms (poles) 72, 74 are of a spring material and are biased toward the ground plate 78. Thus, in the static state button 84 of switch arm 72 is in contact with button 86 of the ground plate 78 and the contact button 92 of switch arm 74 is in contact with the contact button 94 of the ground plate 78. A push button 56 is provided to move the switch arm 72 into contact with the power plate 76, that is contact button 80 will be in contact with button 82 of the power plate 76. Another push button 58 is provided to move the switch arm 74 toward the power plate 76 thus placing button 88 in contact with button 90. Each of the push buttons 56, 58 are biased outwardly as indicated by arrow 57 by springs 98.

Figure 4B:
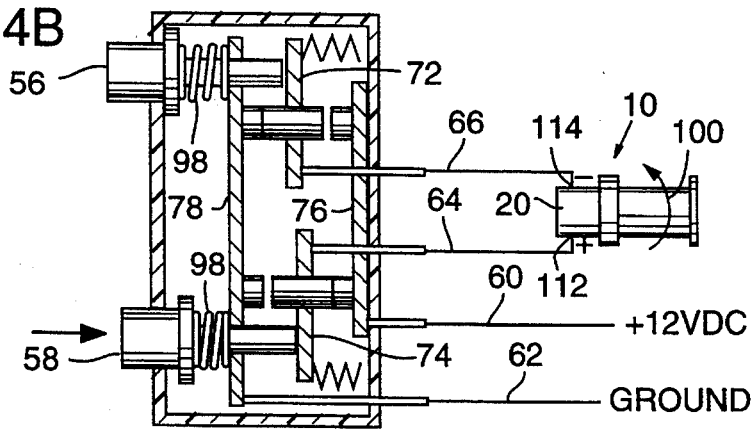
Figure 4C:
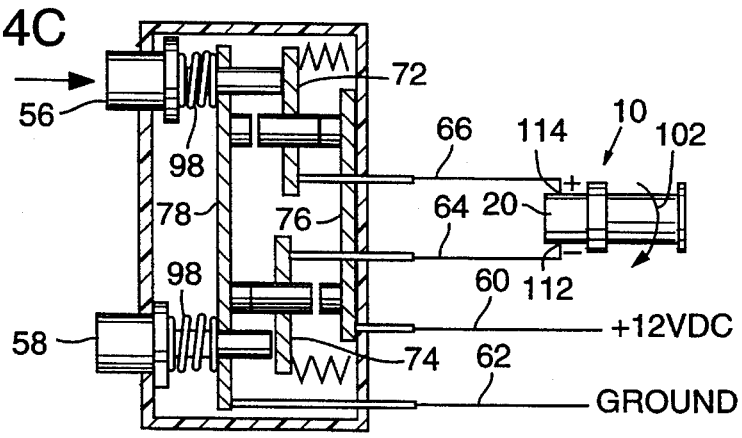

FIG. 4A–4C illustrates in diagram form the operation of the remote control 50. FIG. 4A shows the remote control in the static state, this is, neither push button 56 or 58 have been depressed. As shown, each switch 72, 74, (switch arm 72, 74) is connected to ground (via ground plate 78 and conductor 62).

FIG. 4B shows the condition when push button 58 is depressed. As shown, the switch 74 (switch arm 74) has been moved from a connection with the ground plate 78 to a connection with the power plate 76 (the power plate 76 is connected to a power source such as the battery 16 of the vehicle 12 by conductor 60). Switch 74 will thus supply power via conductor 64 to a motor terminal 112 to provide motive power for the motor 20. Motor terminal 114 is connected to ground via conductor 66, the switch 72, the ground plate 78 and conductor 62 to complete the circuit. The motor 20 will be driven in the rotative direction as indicated by the directional arrow 100.

FIG. 4C illustrates the condition where push button 56 has been depressed. As shown, the switch 72 (switch arm 72) has been moved from a connection with the ground plate 78 to a connection with the power plate 76 (the power plate 76 is connected to a power source such as the battery 16 of the vehicle 12 by conductor 60). Switch 72 will thus supply power via conductor 66 to a motor terminal 114 to provide motive power for the motor 20. Motor terminal 112 is connected to ground via conductor 64, the switch 74, the ground plate 78 and conductor 62 to complete the circuit. The motor 20 will be driven in the rotative direction as indicated by the directional arrow 102.

It is advantageous to have the motor leads 112 and 114 electrically coupled together as shown in FIG. 4A when the control 50 is in the static or off position. Consider that the remote control 50 was utilized to operate the winch 10 by depressing the button 58 as illustrated in FIG. 4B. When the button 58 is released to cut off power to the winch 10 (the condition illustrated in FIG. 4A), the motor 20 instead of continuing to run due to a load on the wire rope 26 or simply coasting to a stop will be dynamically braked due to the interconnection of the motor leads 112 and 114 referred to as a short connection.

Figure 5:
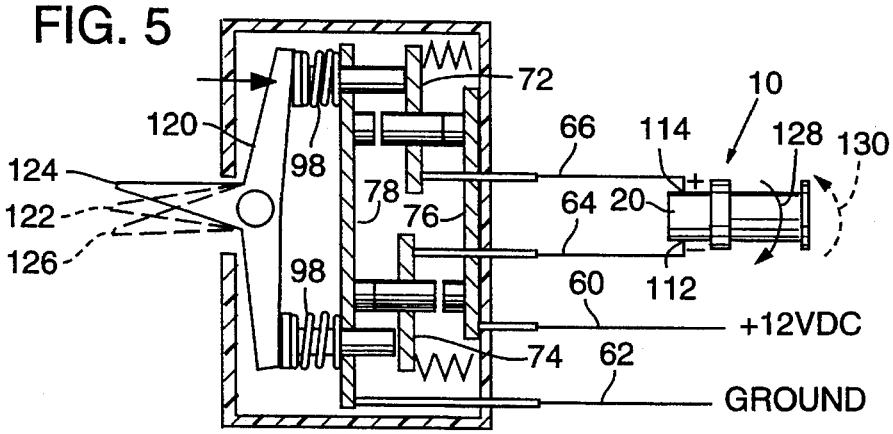
FIG. 5 is a view illustrating an alternate embodiment of the remote control of the winch of FIG. 1.

Those skilled in the art will recognize that modifications and variations may be made without departing from the true spirit and scope of the invention. The push buttons 56, 58 may for example be replaced by a single operating lever (toggle) 120 as indicated in FIG. 5. The lever 120 is pivotally mounted in the handle 54 and is normally biased to the center position. The center position is indicated by the numeral 122 and in this position the switches 72, 74 are biased to a connection with the ground plate 78 (ground) in the same manner as shown in FIG. 4A when neither push button 56 or 58 is depressed. The lever 120 when pivoted to position 124 moves the switch 72 into contact with the power plate 76 to supply power to the motor 20 via conductor 66 to cause rotation of the motor in the direction as indicated by the directional arrow 128. The lever 120 when pivoted to position 126 will move the switch 74 into contact with the power plate 76 to supply power to the motor 20 via conductor 64 to cause rotation of the motor 20 in the direction indicated by the dashed directional arrow 130. The above is but one example of a modification and/or variation contemplated in the remote controlled winch of the present invention.

The invention is therefore not to be limited to the embodiments described and illustrated but is to be determined from the appended claims.

What is claimed is:

1. A winch comprising:

a base structure;

a drum rotatably mounted on the base structure;

an electrically powered motor including a drive shaft coupled to the drum, said motor arranged to rotate the shaft and drum coupled thereto in opposite rotative directions in response to reversal of polarity of electrical power input to the motor from a pair of power source conductors;

an electrical power source and a first pair of conductors from said power source including a power conductor and a ground conductor;

a remote control and a second pair of conductors from the remote control to the motor for supplying said electrical power input to the motor, said first pair of conductors extended to said remote control and terminating in exposed terminal ends in spaced apart relation, said second pair of conductors having exposed terminal ends in spaced apart relation positioned between said exposed terminal ends of said first pair of conductors, said terminal ends of said second pair of conductors biased toward the exposed terminal end of said ground conductor of said first pair of conductors; and a mechanism engageable with the terminal ends of said second pair of conductors for selectively manually moving said terminal ends of said second pair of conductors away from the exposed terminal end of said ground conductor toward the exposed terminal end of said power conductor for selective and reversal power input to said winch motor.

2. A winch as defined in claim 1 wherein:

said mechanism includes first and second manual push buttons.

3. A winch as defined in claim 2 wherein:

said mechanism includes a toggle.

4. A winch as defined in claim 1 wherein:

said remote control includes a housing containing said terminal ends and said mechanism for moving said terminal ends, said housing formed into a hand piece.

* * * * *